US005570486A

United States Patent [19]

Wiedeck

[11] Patent Number: 5,570,486

[45] Date of Patent: Nov. 5, 1996

[54] BRIDGE CONSTRUCTION AND METHOD OF ASSEMBLY

[75] Inventor: Hans-Norbert Wiedeck, Mülheim/Ruhr, Germany

[73] Assignee: Krupp Fordertechnik GmbH, Duisburg, Germany

[21] Appl. No.: 448,197

[22] Filed: May 23, 1995

[30] Foreign Application Priority Data

Jun. 1, 1994 [DE] Germany ..... 44 19 203.7

[51] Int. Cl.[6] ..... E01D 19/00

[52] U.S. Cl. ..... 14/13; 14/14

[58] Field of Search ..... 14/2.4, 2.5, 2.6, 14/3, 4, 5, 6, 7, 8, 13–14, 73.1, 77.1; 52/645, 646

[56] References Cited

U.S. PATENT DOCUMENTS 5,414,885 5/1995 Berlin et al. ..... 14/4

FOREIGN PATENT DOCUMENTS

| | | |
|---|---|---|
| 2157517 | 6/1973 | France . |
| 573727 | 3/1933 | Germany . |
| 1534435 | 5/1969 | Germany . |
| 666500 | 7/1988 | Switzerland . |
| 104307 | 3/1917 | United Kingdom . |

*Primary Examiner*—Tamara L. Graysay
*Assistant Examiner*—Pamela A. O'Connor
*Attorney, Agent, or Firm*—Herbert Dubno

[57] ABSTRACT

A bridge is assembled by locking truss-like girders along the sides of a bridge section to the transverse beams by a bayonet-type coupling and a swinging of the trusses relative to the transverse beams. Roadway plates are supported by the transverse beams and additional sections are assembled onto the previous sections. The sections can be advanced across an obstruction on a pair of support beams guided through roller frames affixed to at least the first and last sections, which support beams can later be mounted on the bridge span to function as guardrails.

15 Claims, 8 Drawing Sheets

FIG. 1
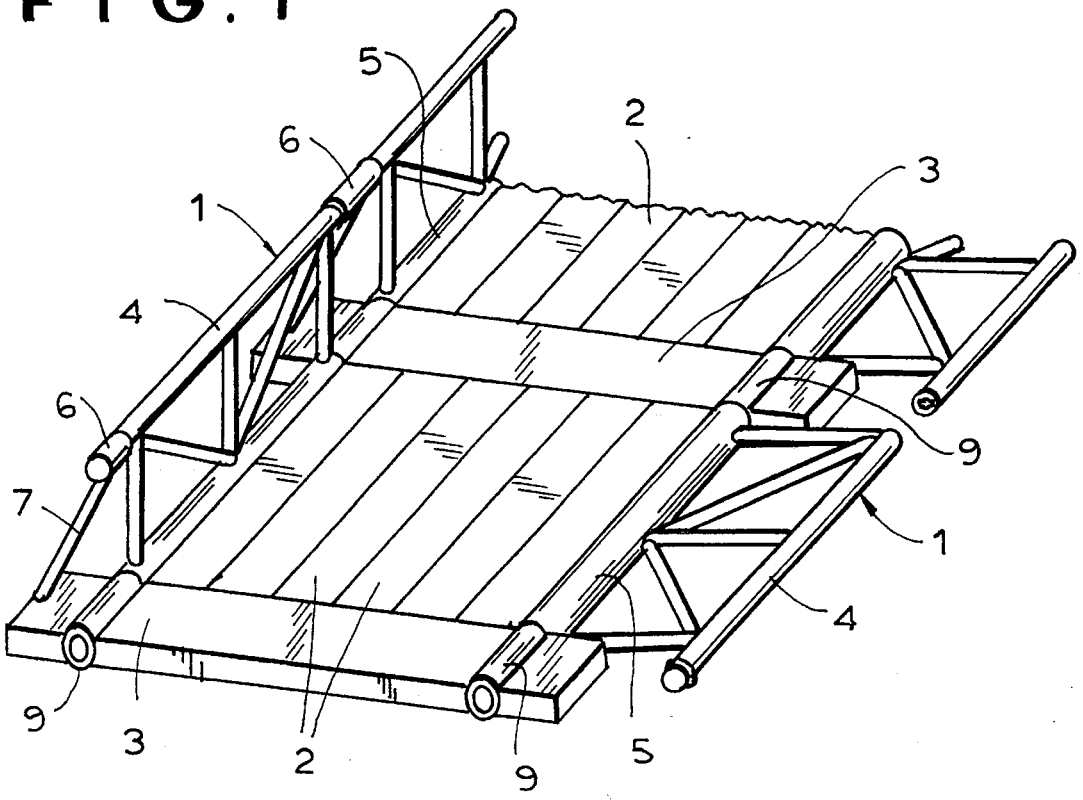
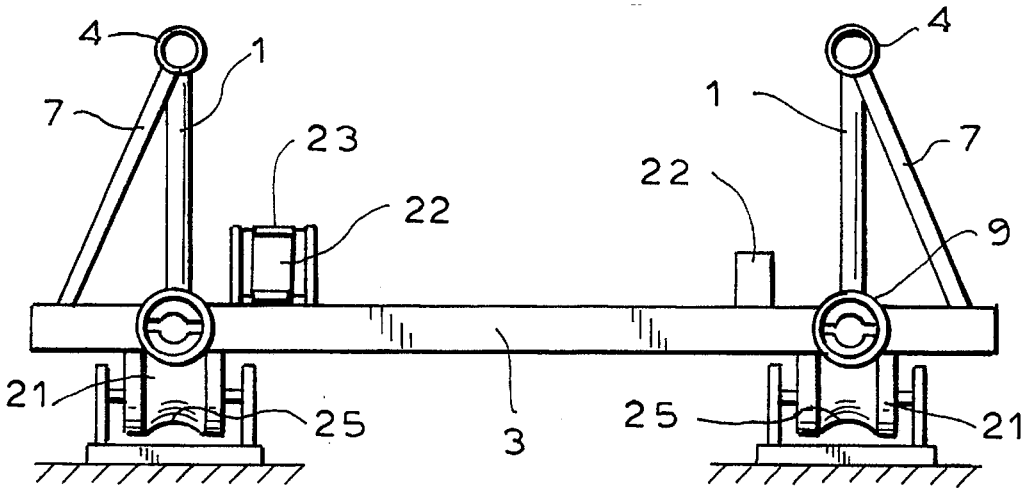
FIG. 2

FIG. 5A
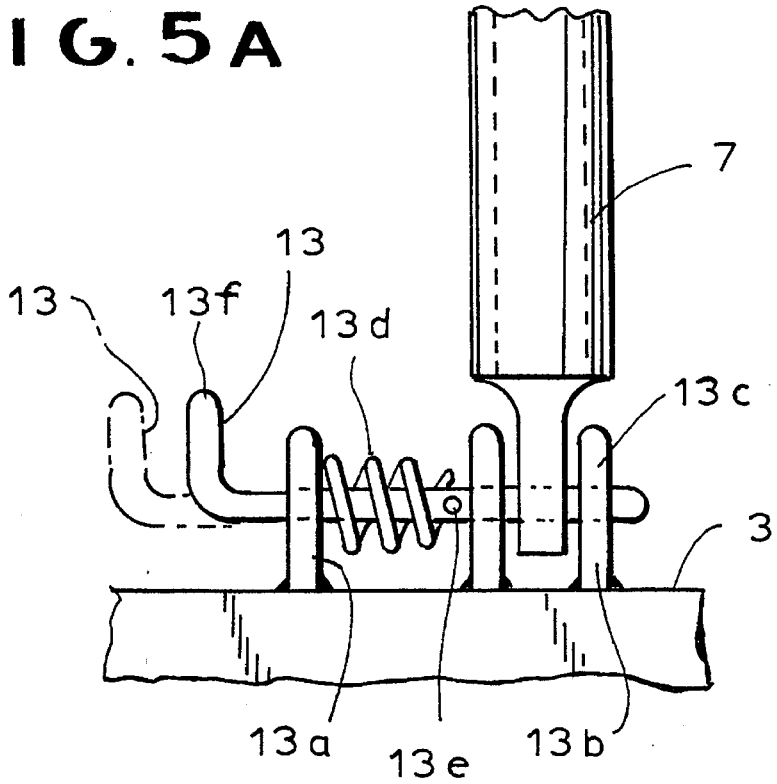
FIG. 5B
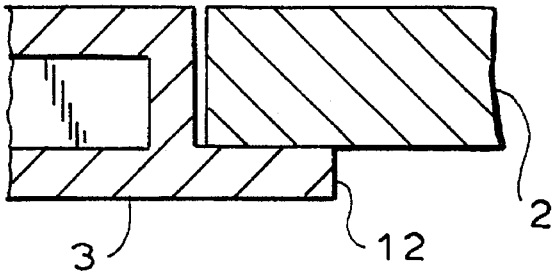
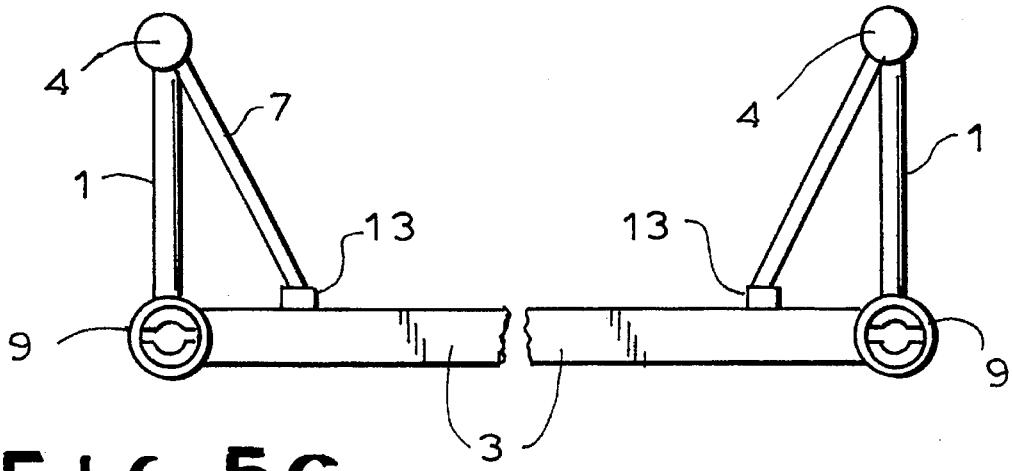
FIG. 5C

BRIDGE CONSTRUCTION AND METHOD OF ASSEMBLY

SPECIFICATION

1. Field of the Invention

My present invention relates to a bridge construction and a method of bridge assembly, especially for bridges which are to be shifted to lie between two embankments over an obstruction to be crossed by the bridge.

2. Background of the Invention

There are bridges which are capable of being assembled at the site of an obstruction to be crossed by the bridge. Such bridges include the British Bailey Bridge and the D Bridge of the Friedrich Krupp firm.

With these bridge systems, the bridge can be assembled from a multiplicity of parts, including longitudinal girders which can be formed as trusses, transverse beams which extend transversely to these girders, and at least one roadway forming plate which is supported by and extends between the transverse girders. The trusses which constitute the girders may have upper and lower chords and when the bridge is formed from bridge sections of the aforedescribed construction, the upper and lower chords or the sections may be connected in end-to-end relationship to produce the bridge.

One of the drawbacks of earlier systems of this type is that they utilize a large number of relatively small parts which can easily be lost in transport which must be bolted together for assembly in a time-consuming manner and which otherwise can be considered complex and difficult to erect.

OBJECTS OF THE INVENTION

It is therefore an object of the present invention to provide an improved process or method of assembly of a bridge which allows erection of a bridge structure across an obstruction in a reliable simple and rapid manner.

Another object of the invention is to provide a bridge construction which facilitates rapid assembly, avoids the drawbacks of prior art systems and, in general, enables the bridge to be erected quickly and without problems such as loss of significant parts in transport.

SUMMARY OF THE INVENTION

These objects and others which will become apparent hereinafter are attained, in accordance with the invention, by providing bridge sections whose girders or trusses are connected to the transverse beams by a plug coupling which can be locked by a relative swinging action of the transverse beams and the girders to secure the engagement of the transverse beams with the girders, in the erect or locked position, the girders being braced by struts under compression and disposed between upper chords of the trusses and the transverse beams to form triangular bracing formations with the trusses.

According to the invention, therefore, a bracing triangular section can be provided at each end of the trusses, or where the struts are constituted by another girder or truss articulated to the first-mentioned girder along the upper chords, by such other girder or truss. With the system of the invention, therefore, the bridge sections can be assembled from relatively few parts rapidly since no small components or parts are required.

A simple plug and sleeve connection can be provided between the lower chord of each girder and a respective transverse beam and reverse swinging to release the connection can be blocked by the bracing strut or truss. Since the swinging action locks each girder to the respective transverse beam, no additional bolting action need be provided.

The tubular upper chords of aligned girders or trusses can be connected by interfitting them with sleeves which can be formed as part of the upper chords of the girders or can be separate elements interconnecting the upper chords, the sleeves forming preferably bayonet connections which can be locked by a rotation of the sleeve relative to the upper chords of the two trusses or girders joined thereby.

According to another feature of the invention, the struts can be bars which are fixed to these sleeves.

Also in accordance with the method aspect of the invention, the bridge can be caused to span an obstruction between two embankments by adding sections as counterweights to an initial section, feeding a pair of support beams across the obstructions between the embankments through roller assemblies on at least the initial bridge section, whereby the bridge sections as they are advanced over the obstruction are suspended by the support beams until they reach the other embankment, additional sections being added as required, and the span across the obstruction between the embankments being then lowered by lowering the support beams. The ends of the support beams can thus be provided with mechanisms for raising and lowering same, for example, air cushions. The bridge sections can be fed over the obstruction on rollers on the embankment at which the sections are assembled. In that case, the lower chords of the trusses or girders of the successive sections can be guided in grooves of these feed rollers.

The aforedescribed method of erecting a bridge across an obstruction is facilitated by providing a hammerhead-shaped element at the end of each lower chord of the respective girder for engagement in an opening or passage in the transverse beam into which that hammerhead formation can lock by the relative swinging of the girder and the transverse beam. The result is a secure and reliable connection of the transverse beam to the girder.

By providing the struts on the respective sleeves, the need for additional elements for securing the struts can be avoided and the struts can be used to rotate the sleeves to lock the bayonet connections described.

According to a feature of the invention, the sleeves are longitudinally shiftable so that they can interconnect the upper chord ends of two successive trusses or girders. With this system, each sleeve can function as a connection for the chord ends and requires only one strut for the particular connection region.

The bayonet connection described previously may provide the sleeve with pairs of inner projections which can engage behind a pair of outer projections of plug formations of the upper chord of the truss or girder when the block formation is inserted into the sleeve and the sleeve is rotated. This connection has been found to be advantageous since it allows the upper chords which are normally under compression also to be placed under tension which is especially advantageous for pioneer bridges.

As has also been noted previously, instead of individual bars as struts located only at the coupling between the upper chords of successive girders or trusses, along each side of each bridge segment, a pair of trusses can be provided to define the bracing triangle previously described, one of the trusses forming the longitudinal girder while the other functions as a bracing element. The two trusses can be connected together at a common upper chord.

The struts can run from vertical girders or trusses to extensions of the transverse beams disposed outwardly of these trusses. In that case, the full traveled way of the bridge between two girders may be made available and the struts do not obstruct the traveled way.

The construction whereby two girders are provided on each side of each bridge section is preferably used for bridges of greater load-carrying capacity.

The girders along each side may have sleeves which alternate with one another and are aligned to receive a cylindrical member traversing these sleeves.

The girders can all be of the same dimensions so that they can be interchangeable and can be employed in conjunction as transverse beams which can be also interchangeable for bridges with different capacities.

According to a feature of the invention, the cylindrical member traversing the sleeves of the two girders forming the upper chord and alternating with one another has a hinge structure for which the cylindrical member is a pintle which can extend between the middles of two successive bridge sections, eliminating the need or a special plug connection for other shear-resisting means for the upper chords of the bridge.

The transverse beam at both ends at least along its underside, can be provided with a cylindrical projection in the form of a tube segment with which the tubular lower chords or lower chord parts of the girders are flush to form generally cylindrical rails riding on the rollers upon which the bridge sections can be shifted into position.

It has been found to be advantageous, moreover, to provide the transverse girders so that they are symmetrical in both the longitudinal and transverse directions of the bridge. This simplifies fabrication and mounting.

The girder elements excluding the sleeves are also advantageously symmetrical in the longitudinal and transverse directions of the bridge. When the sleeves connect to successive upper chord ends together at a particular junction, only one of the sleeves need be provided with the strut. This is the case as well where a number of sleeves can be provided at each end of an upper chord.

To simplify the assembly of the bridge and to make the assembly more reliable, at least a part of the transverse beam at its upper side can be provided with a pair of symmetrical roller frames through which the support beam can pass, the support beam being utilized in the manner described. The means for fastening the roller frames can be alternatively used, once the beam is in place, to secure a guardrail to the bridge and, in accordance with the invention, the support beam can also be utilized as a guardrail. The support beam or guardrail can be of box cross section and can be assembled from interfitting a multiplicity of elements which can be elongated in the direction of the bridge sections.

More particularly, a method emplacing a bridge can comprise the steps of:

(a) providing an end beam, at least one roadway element bridging two of the end beams, and a pair of longitudinal girders adapted to interconnect the end beams and to flank the roadway element, the girders being formed as trusses with upper and lower chords;

(b) connecting the girders to the end beams by interfitting an end of each lower chord and a respective end beam to form a plug connection therewith and relatively swinging the respective girder and end beam about a respective axis from an assembly position into an erect position of the girder relative to the end beam to secure the plug connections, thereby forming a respective bridge section from at least one end beam a respective roadway element and a pair of girders;

(c) interconnecting aligned ends of upper chords of a plurality of the bridge sections at respective couplings; and (d) bracing the upper chords relative to the end beams with respective compression struts inclined to the planes of the respective girders, engaged with the end beams and forming triangular bracing formations with the respective end beams and girders.

Specifically, for crossing an obstruction between two embankments, in the mounting of the bridge to span two embankments, two longitudinal support beams are fed from a first of the bridge sections at one of the embankments across to an opposite embankment, additional bridge sections are added to the first section to form counterweights for the first section, the first section suspended from the support beams is fed from the one embankment toward the opposite embankment, additional bridge sections are added as the sections are advanced between the embankments until the sections form a complete bridge spanning the embankments, the bridge formed from the sections is then lowered by the support beams onto the embankments.

The bridge structure can comprise:

a multiplicity of bridge sections interconnected in end-to-end relationship, the bridge sections each comprising:

an end beam, at least one roadway element adapted to span a pair of such end beams, a pair of longitudinal girders adapted to interconnect the end beams and to flank the roadway element, the girders being formed as trusses with upper and lower chords, a respective hammerhead coupling element formed on an end of each lower chord and complementarily received in a throughgoing opening in the respective end beam for locking the coupling elements to the end beams upon swinging of the girders from assembly positions into erect positions relative to the end beams, thereby connecting the sections together at the respective end beams and aligning upper chords of the respective girders;

respective couplings between the upper chords of successive bridge sections; and respective compression struts inclined to the planes of the respective girders, engaged with the end beams and forming triangular bracing formations with the respective end beams and girders.

BRIEF DESCRIPTION OF THE DRAWING

The above and other objects, features, and advantages will become more readily apparent from the following description, reference being made to the accompanying drawing in which:

FIG. 1 is a perspective view in highly diagrammatic form, showing a bridge section according to the invention;

FIG. 2 is a transverse cross section through the bridge section of FIG. 1;

FIG. 5A is a detail of the attachment of a strut to the transverse beam;

FIG. 5B is a cross sectional view showing the mounting of a road plate on the transverse beam;

FIG. 5C is a side view of a transverse beam in another embodiment of the invention;

SPECIFIC DESCRIPTION

Figure 3A:
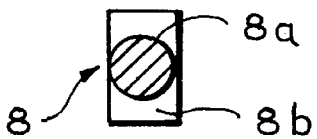
FIG. 3A is a cross sectional view taken along the line IIIA—IIIA of FIG. 3 drawn to a larger scale.

In FIG. 1, there is shown a complete bridge section and a portion of a second bridge section coupled thereto, each of the interconnected sections being comprised of support beams 3 which are spanned by the girders 1 and a multiplicity of roadway plates 2 bridging the transverse beams 3. As can be seen in the drawing, the roadway plates 2 run from one transverse beam 3 to the next transverse beam to define a roadway for the bridge, while the girders 1, in the form of trusses, flank the roadway. Between each pair of transverse beams 3, a pair of trusses 1 extend. On the right side of FIG. 1, the trusses or girders 1 are shown in a substantially horizontal position, after they have been interfitted with the support beams 3 and before they have been rotated into the upright positions in which the lower chords 5 of the girders 1 lock into the transverse beams 3.

In the upright position, the upper chords 4 of the girders 1 are interconnected by, for example, a coupling means including a sleeve 6 which encloses the ends of the upper chords 4 to each of which a strut 7 can be welded. The free ends of the strut 7 can be connected to a portion of the transverse beam 3 in the region of the coupling projecting outwardly of the roadway boundaries and hence outwardly beyond the girders 1.

Figure 3:
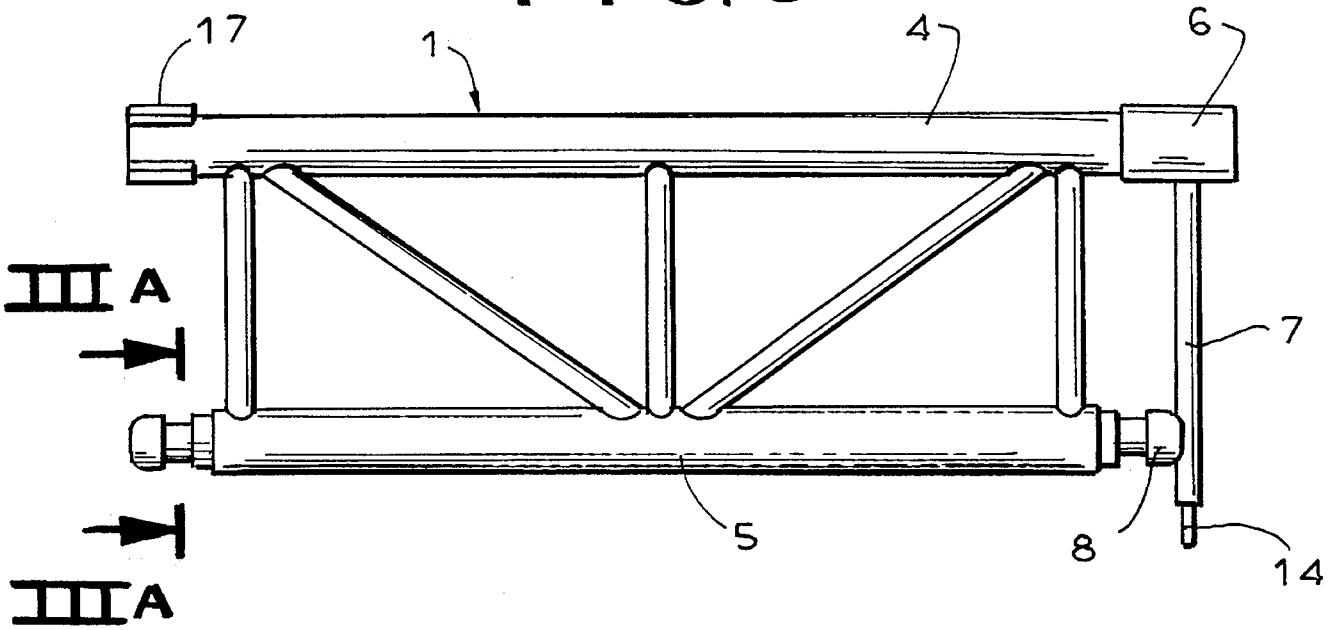
FIG. 3 is a side elevational view of a girder in the form of a truss for the bridge section of FIG. 1.

As can be seen from FIG. 3, for example, the lower chords 5 of each of the trusses 1 forming each girder can have plug formations at its ends which are in the configuration of a hammerhead. The outer ends of the elements 8 are coplanar with the ends of the upper chord 4. The center line of the respective strut 7 can also lie in the plane of the ends of the upper and lower chords as is apparent at the right-hand side of FIG. 3.

From FIG. 3A it will be apparent that the hammerhead formation 8 can comprise a cylindrical neck 8*a* to which the head portion 8*b* is affixed.

Figure 4:
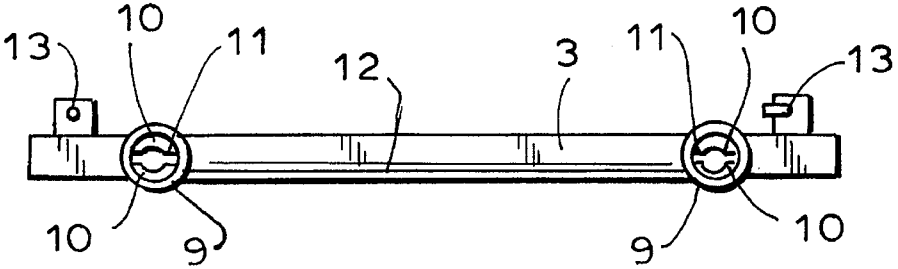
FIG. 4 is a side view of a transverse beam for use in a bridge according to the invention.
Figure 5:
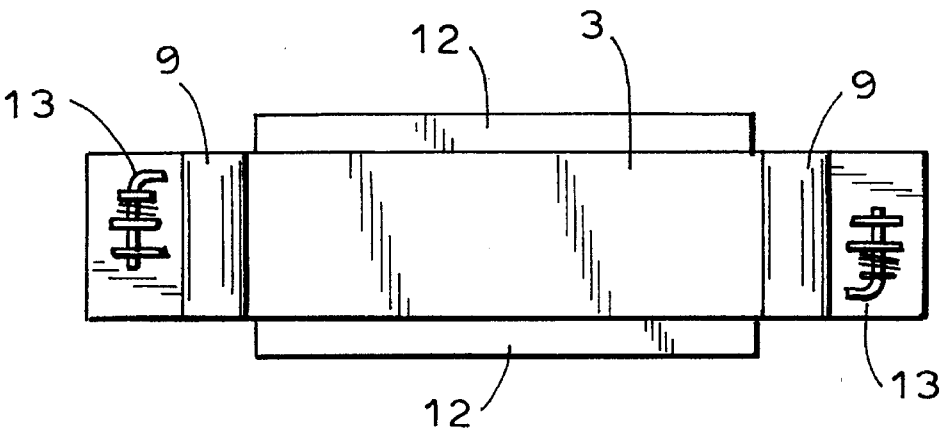
FIG. 5 is a plan view of the beam.

As can be seen from FIGS. 4 and 5, the transverse beams 3 can include tubular portions 9 which form throughgoing passages from one side of the transverse beam to the other and which can be of substantially the same outer diameter as the lower chord 5 but which can include two disk halves or formations 10 behind which the heads 8*b* can engage when each of the formations 8 is plugged into an opening 11 adapted to receive formation 8. The hammerhead formations 8 and the formations 10, 11 provide a bayonet coupling which allows insertion of the hammerhead formation when the truss 1 is in the position shown at the right-hand side of FIG. 1 and which locks to prevent withdrawal when the girder is swung into the erect position shown at the left-hand side in FIG. 1.

The transverse beams 3 are composed of a box cross section provided with a ledge 12 upon which the roadway plates 2 can rest (see FIG. 5B).

At the extensions of the transverse beam 3 outwardly of the trusses 1, locking pins 13 can be slidable (between the dotdash slide positions shown in FIG. 5A) in lugs 13*a*, 13*b*, 13*c*, to permit the pin 13 to engage in a bore 14 at the end of the strut 7 to lock the strut to the beam member 3. The pins 13 can be biased into their locking positions by springs 13*d* which can engage against transverse members 13*e* on the pin and which are braced against the lug 13*a*. When the pin 13 is drawn by its handle 13*f* to the left, the strut 7 can be inserted or removed.

While the latch shown in FIG. 5A is located on the outer extension of the transverse beam 3 to provide a traveled way which is the full width of the roadway formed by the plates 10 in FIGS. 1 and 2, in the embodiment of FIG. 5C, the struts can be anchored to the transverse beam 3 by pins 13 located inwardly of the girders 1. In that case, the portions of the transverse beams 3 lying outwardly of the tube segments 9 are eliminated.

Figure 6:
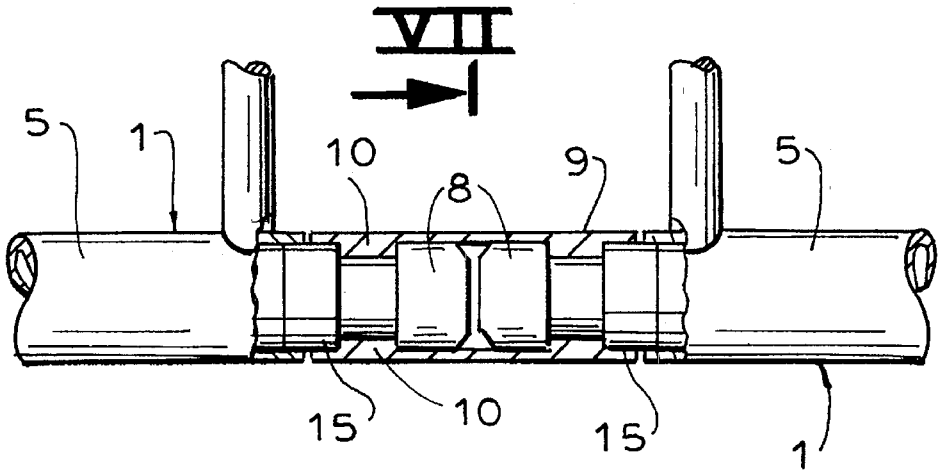
FIG. 6 is a detail of the lower chord coupling.
Figure 7:
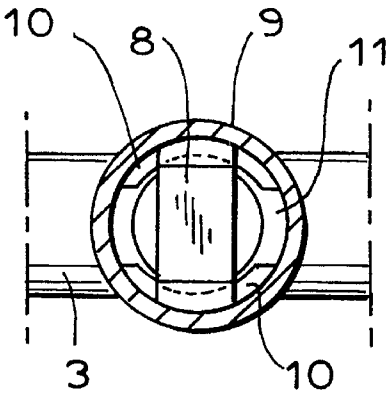
FIG. 7 is a cross sectional view taken along the line VII—VII of FIG. 6.
Figure 8:
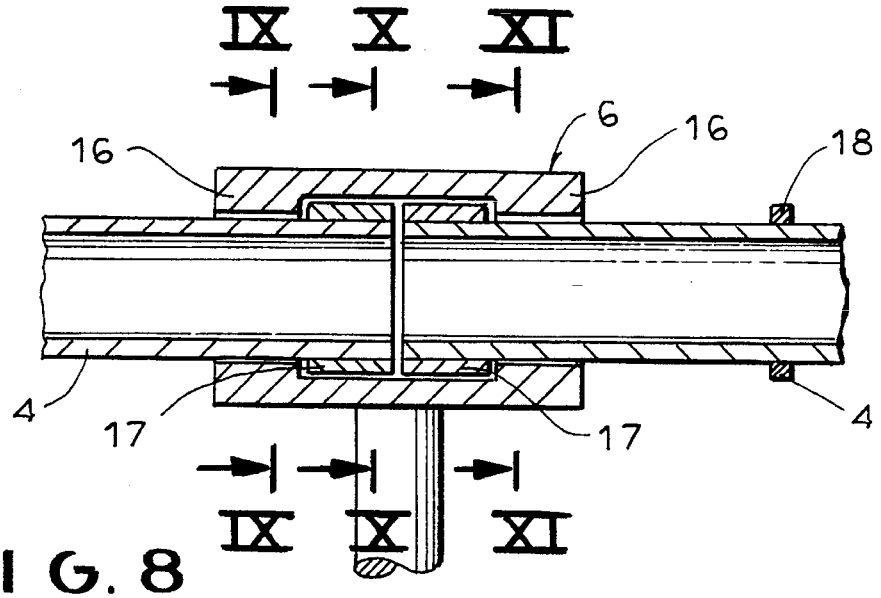
FIG. 8 is a detail of the upper chord coupling also in cross section.
Figure 9:
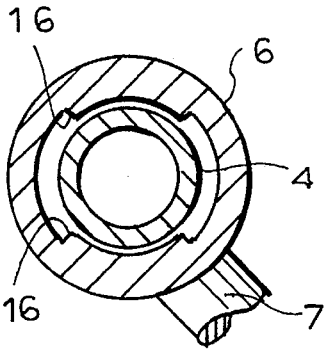
FIG. 9 is a cross sectional view taken along the line IX—IX of FIG. 8.
Figure 10:
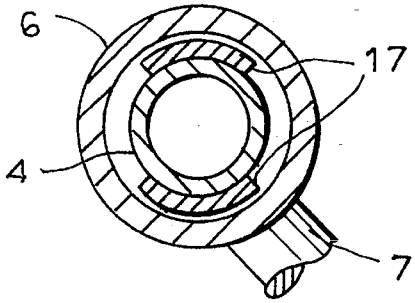
FIG. 10 is a cross sectional view taken along the line X—X of FIG. 8.
Figure 11:
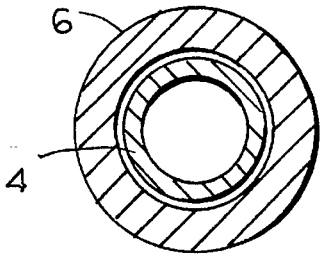
FIG. 11 is a cross sectional view along the line XI—XI of FIG. 8.
Figure 12:
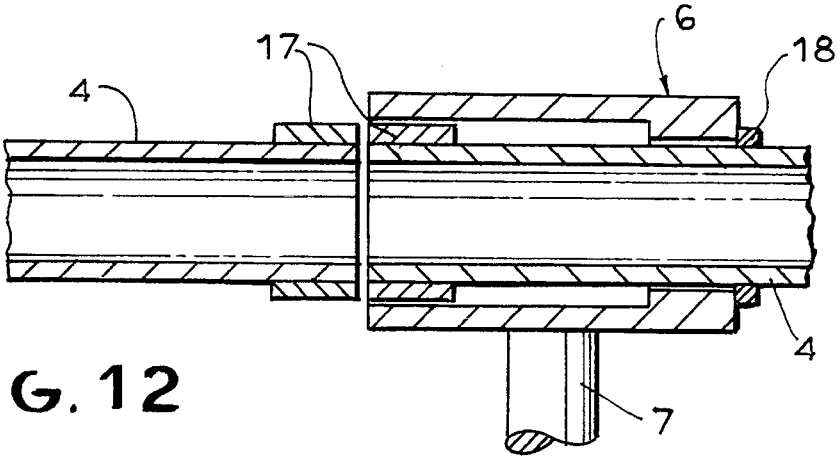
FIG. 12 is a longitudinal section through the upper chord coupling of FIG. 8 illustrated in a decoupled position.

FIGS. 6 and 7 show that the disk halves 10 in the tubular segment 9 of the transverse beam 3 can engage in front of the hammerhead elements 8 or the hammerhead element 8 engage behind the formations when the trusses 1 are swung into the erect position. In the coupled position, the elements 8 can practically abut. Between the ends of the tube segments 9 and the formations 10, the tube formation 9 can be provided with cylindrical seats 15 which can embrace cylindrical portions of the lower chord 5 to additionally stiffen the connection.

FIGS. 8–12 illustrate the connection of the upper chords 4 by a sleeve 6 which also forms a bayonet connection with the upper chords. The sleeve 6, which can have a greater inner diameter than the outer diameter of the upper chords 4 can be provided with two opposite projections 16 which, in cross section, have the configurations of cylindrical segments. Outer projections 17 of the same shape are provided flush with the ends of the upper chord 4. In the position shown in FIG. 8, the projections 17 engage behind the projections 16 in the longitudinal direction of the bridge as a result of a rotation of the sleeve through 90° into the locking position. As a comparison of FIGS. 9 and 10 will show, before the coupling sleeve 6 is rotated into the locking position, the formations 17 can pass between the formations 16 as the ends of the upper chords 4 are inserted into the sleeves 6 or the sleeves 6 are passed over the ends of the upper chords. The decoupling is effected by releasing the respective strut 7 from its anchoring pin 13 and swinging the strut 7 through 90°, thereby aligning the formations 17 with the spaces between the formations 16 and enabling the sleeve 6 to be shifted axially from the position shown in FIG. 8 against the stop 18 into the position shown in FIG. 12.

Since the right-hand end of the sleeve 6 is circumferentially continuous (FIG. 11), the sleeve 6 cannot be lost from the upper chord 4 at the right-hand side. If the sleeve is to be removably mounted on the upper chord, both ends can be provided with the formations 16 and, in that case, the sleeve can be removed by aligning the formations 17 with the spaces between the formations 16.

Preferably each girder 1 is provided with one sleeve 6 having a strut 7 so that there is only one kind of girder necessary. In that case, it is not required to provide an assortment of different girders.

Figure 13:
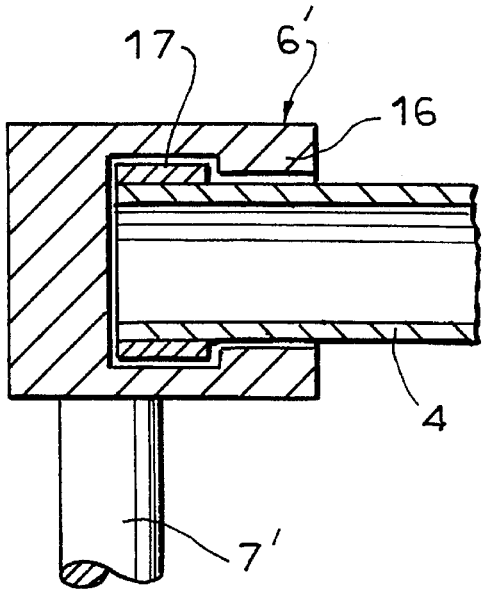
FIG. 13 Is a sectional view of an end cap for the bridge provided with a respective strut.

As can be seen from FIG. 13, where the end of the bridge is not provided with a coupling sleeve or its strut 7, a special strut 7' can be provided on a sleeve 6' closed at one side to engage over the formations 17 via the bayonet connection formed by the formations 16 and 17.

Figure 14:
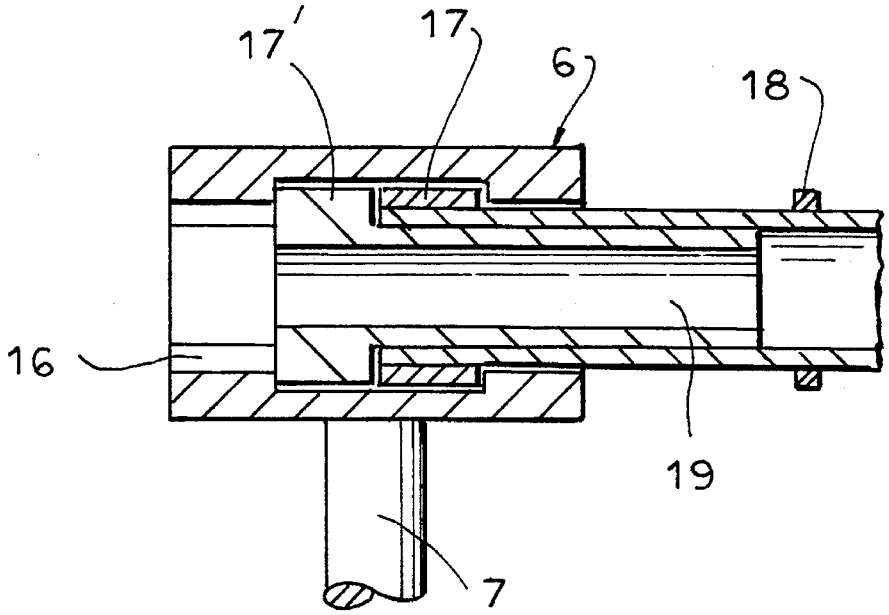
FIG. 14 is a view similar to FIG. 13 illustrating another embodiment of the sleeve at the end of an upper chord.
Figure 15:
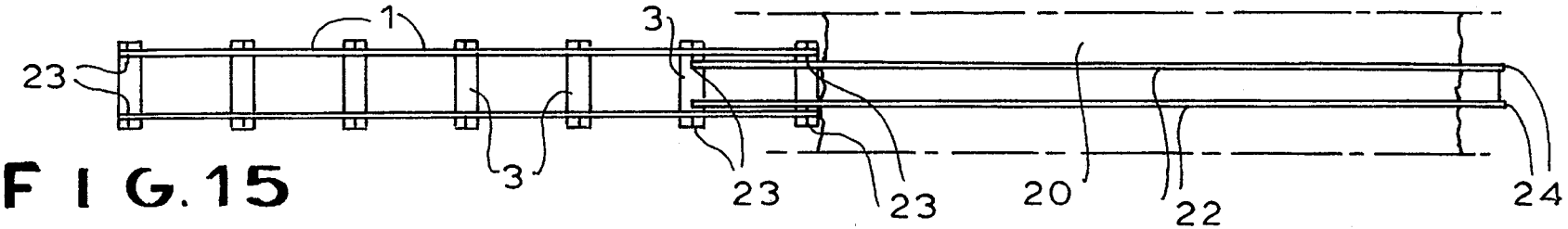
FIG. 15 is a plan view of the assembly of a bridge.
Figure 16:
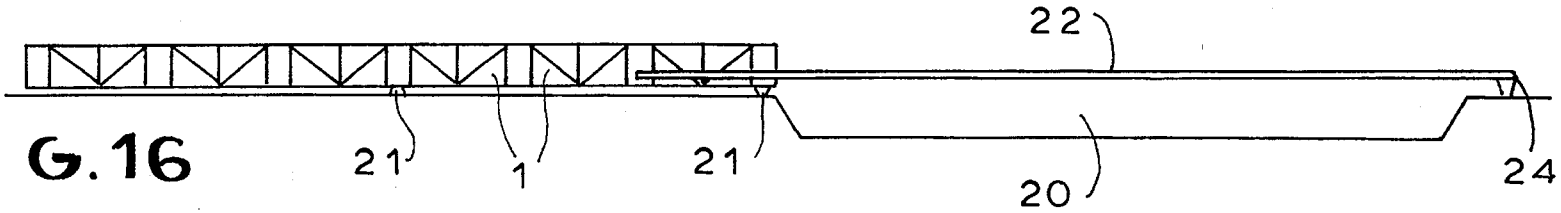
FIGS. 16–18 are side views showing successive steps in the assembly, FIG. 16 corresponding to FIG. 15.
Figure 17:
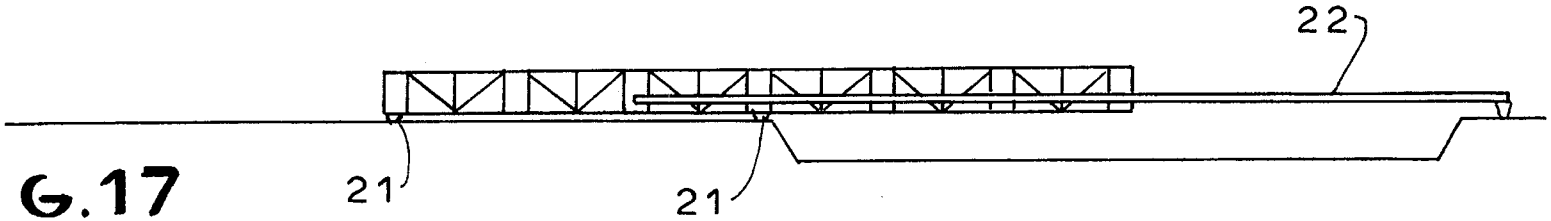
Figure 18:
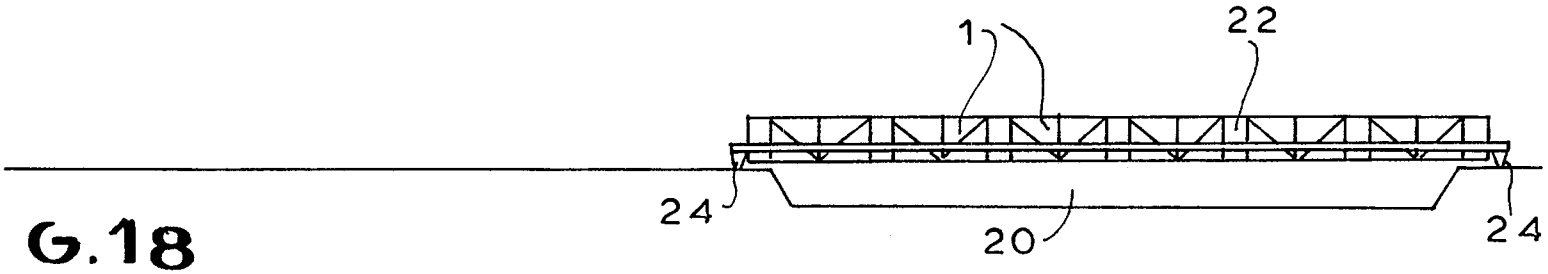

Another type of termination for a bridge end where the upper chord 4 is provided with the standard sleeve 6 has been shown in FIG. 14, wherein the plug 17' can be inserted into the upper chord 4 and can be locked in place by the formations 16 of the sleeve 6. In the embodiment of FIG. 13, a standard sleeve 6 can be cut in half, and a disk welded onto one of the halves.

Figure 19:
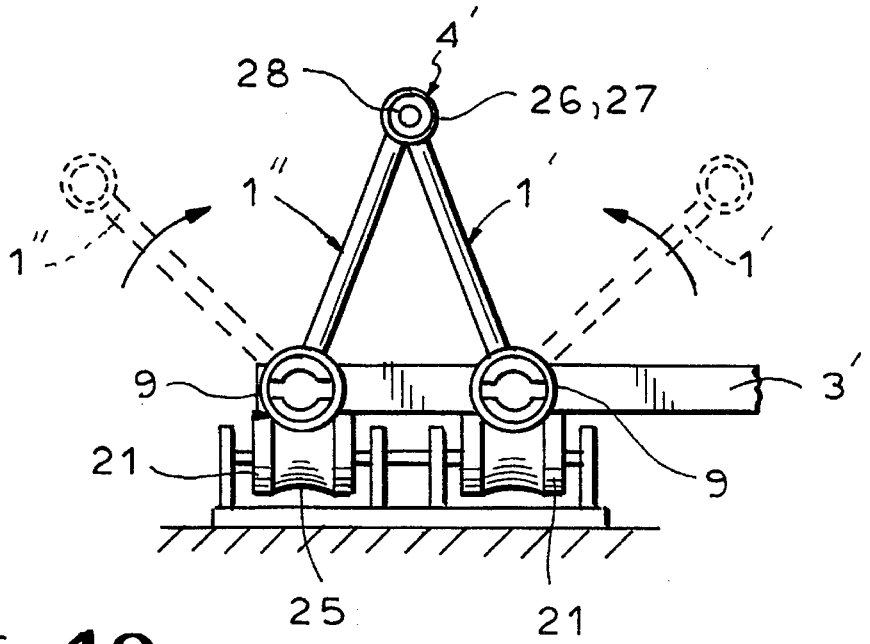
FIG. 19 is a cross sectional view of a bridge with a double girder construction on each longitudinal side.
Figure 20:
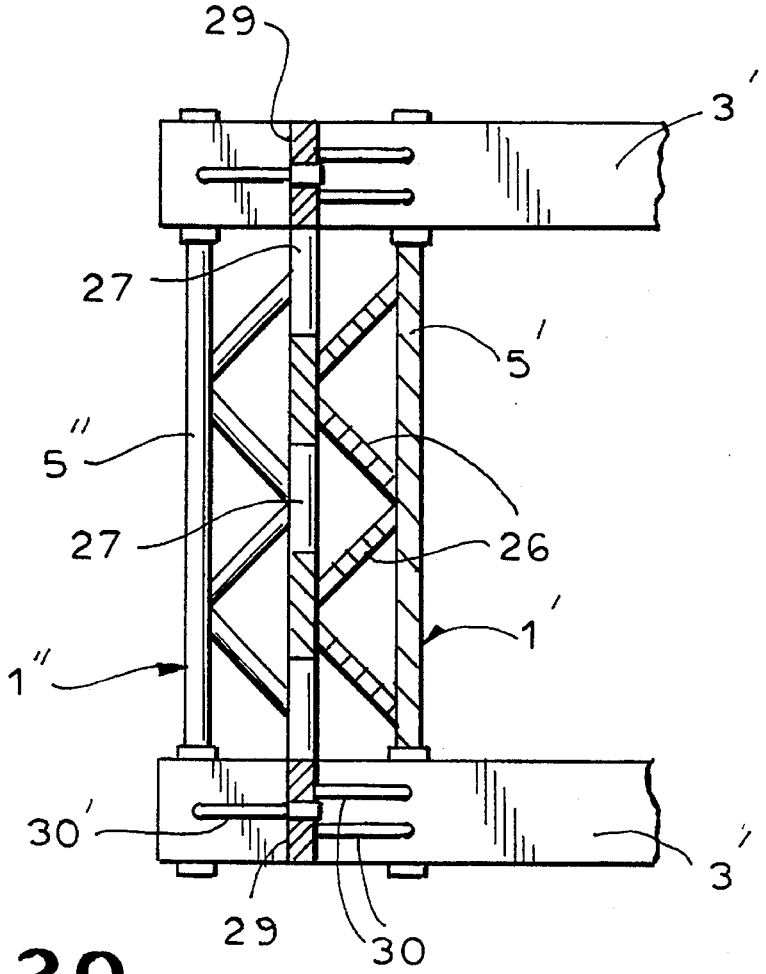
FIG. 20 is a plan view of the structure shown in FIG. 19 with hatching to indicate the different girders.

FIGS. 19 and 20 show an embodiment wherein along each side of the bridge sections, double girders or trusses are provided. In this case, each end of a transverse beam 3' is formed with two tubular segments 9 spaced apart from one another but with the same coupling configuration as in the embodiment of FIGS. 1–7. The lower chords 5' and 5" of two girder elements or trusses 1' and 1" are provided with the hammerhead formations and are engaged in the respective tubular segments.

As can be seen from FIG. 20, the girders 1' and 1" can be formed as trusses with tubular members 26 and sleeves 27, the latter being aligned and alternating between the two trusses 1' and 1" when the respective trusses are swung into their locking positions. A tubular member 28 can then be passed through aligned sleeves 27. Between the sleeves 27 of successive girders 1" there is a gap of the width of the transverse beam 3' and which is bridged by spacer sleeves 29 each connected with a respective truss 30, and a disk connected with a truss 30' the truss having their free ends anchored to the transverse beam 3' by locking pins 13 in the manner previously described. Once the trusses 1' and 1" are swung upwardly into their locking positions (compare the broken line positions in FIG. 19 with the solid line position thereof), the spacer sleeves 29 can be inserted and the truss 30 and 30" locked in place. The sleeves 29 can be flush with the sleeves 27.

The tube 28 can be locked so that it does not shift relative to the sleeves 27 by a locking arrangement or detent (not shown) and if desired, the sleeve 29 can be eliminated when the terminal sleeves 27 are so elongated that they bridge to the next girder 1". A unit is thus formed by a pair of girders or four girders, a transverse beam and the respective roadway plates. The member 28 can run from the middle of one unit to the middle of the next. The shortest bridge which can be assembled can correspond to the length of the shortest pair of girders and two transverse beams 3 or 3'.

FIGS. 15–18 show the use of the bridge sections of the invention for erecting a bridge over an obstruction 20 flanked by two embankments. In the embodiment shown, the bridge is assembled with single truss structures on each side, six girders along each side with seven transverse beams 3, the number of bridge sections which are interconnected being selected to satisfy the need for such sections as a counterweight.

The first section is advanced on the feed rollers 21 from the left-hand embankment after the counterweighting sections have been applied.

The transverse beams of the first section are provided with mountings enabling roller frames 23 to be affixed thereto and a pair of light support beams 22 are threaded through these roller frames 23 and advanced across the obstruction 20 to the other embankment. As can be seen at the left-hand side of FIG. 2, the means for attaching the roller frames can be screw holes. On the opposite embankment, the support beams 22 are provided with height-adjustable members 24, for example, air cushions.

The feed rollers 21 are provided with grooves 25 which are shaped to conform to the rail configurations provided by the tubular lower chords 5 and the tubular sections 9 which project at the undersides of the transverse beams 23. If necessary, as the bridge sections are advanced across the obstruction, additional bridge sections are added in the manner described. At least the last of the bridge sections can be provided with roller frames 23 in the manner described so that, as can be seen from FIG. 18, a complete bridge span can be supported over the obstruction 20 on respective air cushions 24 and the support beams 22. The air cushions then lower the span onto the embankments, preferably appropriate foundations have been provided thereon.

The roller frames 23 can then be removed and the mountings for the roller frames can be utilized to permit the support beams 22 to be as guardrails as has been shown at the right side (FIG. 2).

The bridge as described can be used for a one-lane bridge for vehicles as in the case of a pioneer bridge and preferably between the guardrail 22 and the closest girder 1, sufficient place can be left for a pedestrian walkway. The bridge can, however, also be made wider for multiple-lane traffic.

I claim:

1. A method of assembling a bridge, comprising the steps of:

(a) providing an end beam, at least one roadway element bridging two of said end beams, and a pair of longitudinal girders adapted to interconnect said end beams and to flank said roadway element, said girders being formed as trusses with upper and lower chords;

(b) connecting said girders to said end beams by interfitting an end of each lower chord and a respective end beam to form a plug connection therewith and relatively swinging the respective girder about a respective axis from an assembly position into an erect position of the girder relative to the end beam to secure the plug connections, thereby forming a respective bridge section from at least one end beam, a respective roadway element and a pair of girders;

(c) interconnecting aligned ends of upper chords of a plurality of said bridge sections at respective couplings; and (d) bracing said upper chords relative to the end beams with respective compression struts inclined to the planes of the respective girders, engaged with said end beams and forming triangular bracing formations with the respective end beams and girders.

2. The method defined in claim 1 wherein in step (c) the ends of the upper chords are inserted in tubular connecting members which are rotated to lock upper chords of adjacent bridge sections together, a respective one of said struts being connected to each said tubular connecting member and being braced against said end beam upon rotation of said tubular connecting member to lock said upper chords of the adjacent bridge sections together.

3. The method defined in claim 1 wherein, in the mounting of the bridge to span two embankments, two longitudinal support beams are fed from a first of said bridge sections at one of said embankments across to an opposite embankment, additional bridge sections are added to said first section to form counterweights for said first section, said first section suspended from said support beams is fed from said one embankment toward said opposite embankment, additional bridge sections are added as the sections are advanced between said embankments until said sections form a complete bridge spanning said embankments, the bridge formed from said sections is then lowered by said support beams onto said embankments.

4. A bridge comprising:

a multiplicity of bridge sections interconnected in end-to-end relationship, said bridge sections each comprising:

an end beam, at least one roadway element adapted to span a pair of such end beams, a pair of longitudinal girders adapted to interconnect said end beams and to flank said roadway element, said girders being formed as trusses with upper and lower chords, a respective hammerhead coupling element formed on an end of each lower chord and complementarily received in a throughgoing opening in the respective end beam for locking said coupling elements to said end beams upon swinging of said girders from assembly positions into erect positions relative to said end beams, thereby connecting said sections together at the respective end beams and aligning upper chords of the respective girders;

respective couplings between said upper chords of successive bridge sections;

respective compression struts inclined to the planes of the respective girders, engaged with said end beams and forming triangular bracing formations with the respective end beams and girders; and a respective further truss extending along the respective section and interconnected with the respective truss or each of said girders along the upper chord thereof, the upper chords of the interconnected trusses being formed by alternating sleeves of the trusses of each girder and the further truss, the sleeves being affixed together by an elongated cylindrical member traversing the sleeves.

5. The bridge defined in claim 4 wherein said elongated cylindrical member extends between the middles of two bridge sections.

6. A bridge comprising:

a multiplicity of bridge sections interconnected in end-to-end relationship, said bridge sections each comprising:

an end beam, at least one roadway element adapted to span a pair of such end beams, a pair of longitudinal girders adapted to interconnect said end beams and to flank said roadway element, said girders being formed as trusses with upper and lower chords, a respective hammerhead coupling element formed on an end of each lower chord and complementarily received in a throughgoing opening in the respective end beam for locking said coupling elements to said end beams upon swinging of said girders from assembly positions into erect positions relative to said end beams, thereby connecting said sections together at the respective end beams and aligning upper chords of the respective girders;

respective couplings between said upper chords of successive bridge sections: and respective compression struts inclined to the planes of the respective girders, engaged with said end beams and forming triangular bracing formations with the respective end beams and girders, said end beams of at least one of said sections each having a pair of roller frames symmetrically disposed between said girders and through which support beams are guided to suspend said sections.

7. The bridge defined in claim 6 wherein said couplings are sleeves receiving plugs on the upper chords of adjacent sections, each of said sleeves having a respective one of said struts affixed thereto.

8. The bridge defined in claim 6 wherein said couplings are sleeves provided with pairs of internal projections forming respective bayonet couplings, said ends of said upper chords being formed with outer projections flush with respective ends thereof and engageable behind the internal projections of the respective bayonet coupling.

9. The bridge defined in claim 6 wherein said girders are perpendicular to the end beams and said struts extend from each coupling downwardly and outwardly to the respective end beam, said end beams projecting outwardly beyond said girders.

10. The bridge defined in claim 6 wherein the end beams have cylindrical projections received in tubular lower chords of the respective girders, said tubular lower chords extending between said cylindrical projections.

11. The bridge defined in claim 6 wherein said end beams at opposite ends of each section are disposed symmetrically with respect to longitudinal and transverse directions of the bridge.

12. The bridge defined in claim 6 wherein said girders are disposed symmetrically with respect to longitudinal and transverse directions of the bridge.

13. The bridge defined in claim 6 wherein each of said frames is affixed to the respective end beam at a respective fitting, each of said fittings serving to affix a guardrail to the respective bridge sections.

14. The bridge defined in claim 6 wherein said support beams being affixed to said bridge sections as guardrails.

15. The bridge defined in claim 6 wherein said upper chords are provided with sleeves at least at ends thereof, said struts being affixed to said sleeves.

* * * * *